US006390930B1

(12) United States Patent
Gauer

(10) Patent No.: US 6,390,930 B1
(45) Date of Patent: May 21, 2002

(54) GOLF SWING TRAINING DEVICE

(76) Inventor: Robert Gauer, 19 Sherman Rd., Glen Cove, NY (US) 11542

( * ) Notice: Subject to any disclaimer, the term of this patent is extended or adjusted under 35 U.S.C. 154(b) by 47 days.

(21) Appl. No.: 09/587,987

(22) Filed: Jun. 6, 2000

(51) Int. Cl.[7] ..... A63B 69/36
(52) U.S. Cl. ..... 473/257; 473/219
(58) Field of Search ..... 473/219, 257, 473/261, 264, 265

(56) References Cited

U.S. PATENT DOCUMENTS

| | | | | | |
|---|---|---|---|---|---|
| 1,854,392 | A | | 4/1932 | Bambrick | |
| 3,375,010 | A | * | 3/1968 | Panza | 473/264 |
| 3,460,837 | A | | 8/1969 | Cassa, Jr. | |
| 3,554,555 | A | * | 1/1971 | Maori | 473/264 |
| 3,942,802 | A | | 3/1976 | Wright | |
| 3,975,024 | A | * | 8/1976 | Stephan | 473/219 |
| 4,082,287 | A | * | 4/1978 | Berkey | 473/261 |
| 5,069,456 | A | | 12/1991 | Bellagamba | |
| 5,263,719 | A | | 11/1993 | Bunn | |
| 5,346,220 | A | | 9/1994 | Cooper et al. | |
| 5,433,445 | A | | 7/1995 | Melancon | |
| 5,503,395 | A | * | 4/1996 | Cook | 473/261 |
| 5,513,842 | A | * | 5/1996 | Fuss | 473/265 X |
| 5,899,816 | A | | 5/1999 | Pearson | |
| 5,961,393 | A | * | 10/1999 | Heller et al | 473/264 |

FOREIGN PATENT DOCUMENTS

| | | | | |
|---|---|---|---|---|
| GB | 2197210 | * | 5/1988 | 273/186.1 |
| WO | 85/00295 | * | 1/1985 | 273/186.1 |

* cited by examiner

*Primary Examiner*—Raleigh W. Chiu
(74) *Attorney, Agent, or Firm*—Collard & Roe, P.C.

(57) ABSTRACT

The invention relates to a golf swing training device that comprises a platform, and a substantially vertical support for supporting the platform above a ground surface. This platform is raised above the ground surface to allow a club head to swing under this platform. In a preferred embodiment, the substantially vertical support comprises a series of legs that are vertically adjustable and also set on a hinge under the platform. This hinge allows the legs to be collapsed under the platform. The platform is designed to have a series of displaceable poles or bristles designed to outline a swing path for a golf club. When the golf club is swinging in this swing path, the golf club head is held under the platform during the swing. Once the swing has been completed, the club head is released from an underside face of the platform to allow the club head to rise up. In addition, in the preferred embodiment the swing trainer contains an adjustable plate that controls the movement of displaceable poles in the system so that a person's swing path can be adjusted.

15 Claims, 4 Drawing Sheets

GOLF SWING TRAINING DEVICE

BACKGROUND OF THE INVENTION

1. Field of the Invention

The invention relates to a golf swing training device that incorporates a platform and a series of displaceable poles or bristles to help guide a golf club through a swing. More particularly, the invention relates to a golf swing training device that contains a series of adjustable legs to adjust the height of the platform.

This invention is particularly important because it is designed to develop a new way for a golfer to swing a golf club. Previously, golfers were taught to swing a club in one continuous motion, rotating through the swing on both a horizontal and vertical plane. However the new style golf swing requires that the golfer separate his swing such that it has both a vertical component and a horizontal component. To initiate the backswing in this new style, the golfer turns his hips and torso while keeping the club head low to the ground. Once the golfer has turned substantially through his range of motion, the golfer then raises his club in a substantially vertical manner, and cocks his wrists to complete his backswing. In this position the golf club is raised over the golfer's head.

Next, to initiate the downswing, the golfer drops his hands straight down in a substantially vertical manner and then once the golfer drops his hands to a position adjacent to his hips, the golfer next rotates his hips and torso which moves the club head in a substantially horizontal manner. As the golfer rotates through his swing he impacts the ball driving the ball outward to the target. On the swing follow through, the golfer keeps the club head low until he has substantially completed his rotation and then the golfer raises his club head into the air. Essentially the device according to the invention is designed to help a golfer initiate this new style swing.

2. The Prior Art

Golf swing training devices are known in the art. For example, U.S. Pat. No. 5,263,719 to Bunn discloses a golf club swing training device that contains a top platform supported by side walls. The top platform holds the golf club head down during a swing.

U.S. Pat. No. 5,346,220 to Cooper et al. discloses a golf club swing practice device that contains a front face that is angled to teach a golfer an inside out swing.

U.S. Pat. No. 5,899,816 to Pearson, discloses a golf club practice device that contains a substantially vertical support and a substantially horizontal support having a front face designed to guide a golf club.

U.S. Pat. No. 5,433,445 to Melancon discloses a golf swing training device that is disposed between the golfer and the golfer's ball. This swing training device has a front face that controls the inside face of a golfer's golf shaft while the present invention controls the outside face of the golfer's golf shaft.

U.S. Pat. No. 3,460,837 discloses a golf swing training device that contains a pair of legs that are insertable into a ground surface and a spacer bar for spacing the legs apart and a rising bar that controls the path of a golfer's swing. This rising bar is also angled in a substantially semi-circular manner.

U.S. Pat. No. 3,942,802 discloses a golfing aid for improving a golfer's swing comprises a base, a support arm and an elongated rod. In this case, the invention differs from the present invention because there is no platform that forms a guide path for a golf club during a swing.

U.S. Pat. No. 5,069,456 discloses a golf training apparatus that comprises a semi-circular rim that is designed to control the swing path of a golfer. In this case, the semi-circular rim is designed to extend substantially upright so that it guides a golfer's swing by guiding a front edge of the golfer's golf club.

U.S. Pat. No. 1,854,392 to Bambrick discloses a golf club guide that contains a substantially vertical semi-circular swing guide. In this case, the substantially vertical, semi-circular swing guide attaches to a user's club so that the user's club is guided along with this swing guide as it rotates during the user's swing.

Essentially, while swing guides are known in the prior art, swing guides that are collapsible, and contain a substantially adjustable vertical platform are not known in the art.

SUMMARY OF THE INVENTION

The invention relates to a golf swing training device that comprises platform containing displaceable poles or brushes to help guide a golf club through a swing. In this case, this platform is designed so that it supports displaceable poles or brushes that guide a person's golf club head through a golf swing. The platform itself contains a series of elongated support pieces that are designed to support displaceable poles or brushes on the platform. The displaceable poles and bristles are arranged to form a semi-circular swing region in a center region of the platform. This semi-circular swing region allows a person swinging their golf club to turn through their swing and complete a swing with a full turn while keeping their club head low, traveling along a substantially horizontal path towards the hitting surface.

The platform can be positioned between 10 inches and 50 inches off the ground or any other hitting surface by a vertical support formed by a series of telescoping legs. These supports or legs are adjustable via a series of clamps disposed on each of the telescoping legs. When the clamps are tightened around the legs, they fix the legs in the desired elevation. In this way, a person can fix the height of this swing training platform based upon their own swing preferences.

The platform can also be folded up for easy storage. This platform actually comprises two sections formed as mirror images that are joined in a center region by an attachment piece. This attachment piece allows these two mirror image pieces to be detached from each other so that the two sections of the platform can be folded into each other. Thus, when the two pieces meet, the top surfaces fold towards each other to form a more compact device that is easier to carry and ship.

BRIEF DESCRIPTION OF THE DRAWINGS

Other objects and features of the present invention will become apparent from the following detailed description considered in connection with the accompanying drawings which disclose one embodiment of the present invention. It should be understood, however, that the drawings are designed for the purpose of illustration only and not as a definition of the limits of the invention.

In the drawings wherein similar reference characters denote similar elements throughout the several views.

DETAILED DESCRIPTION OF THE PREFERRED EMBODIMENT

Figure 1:
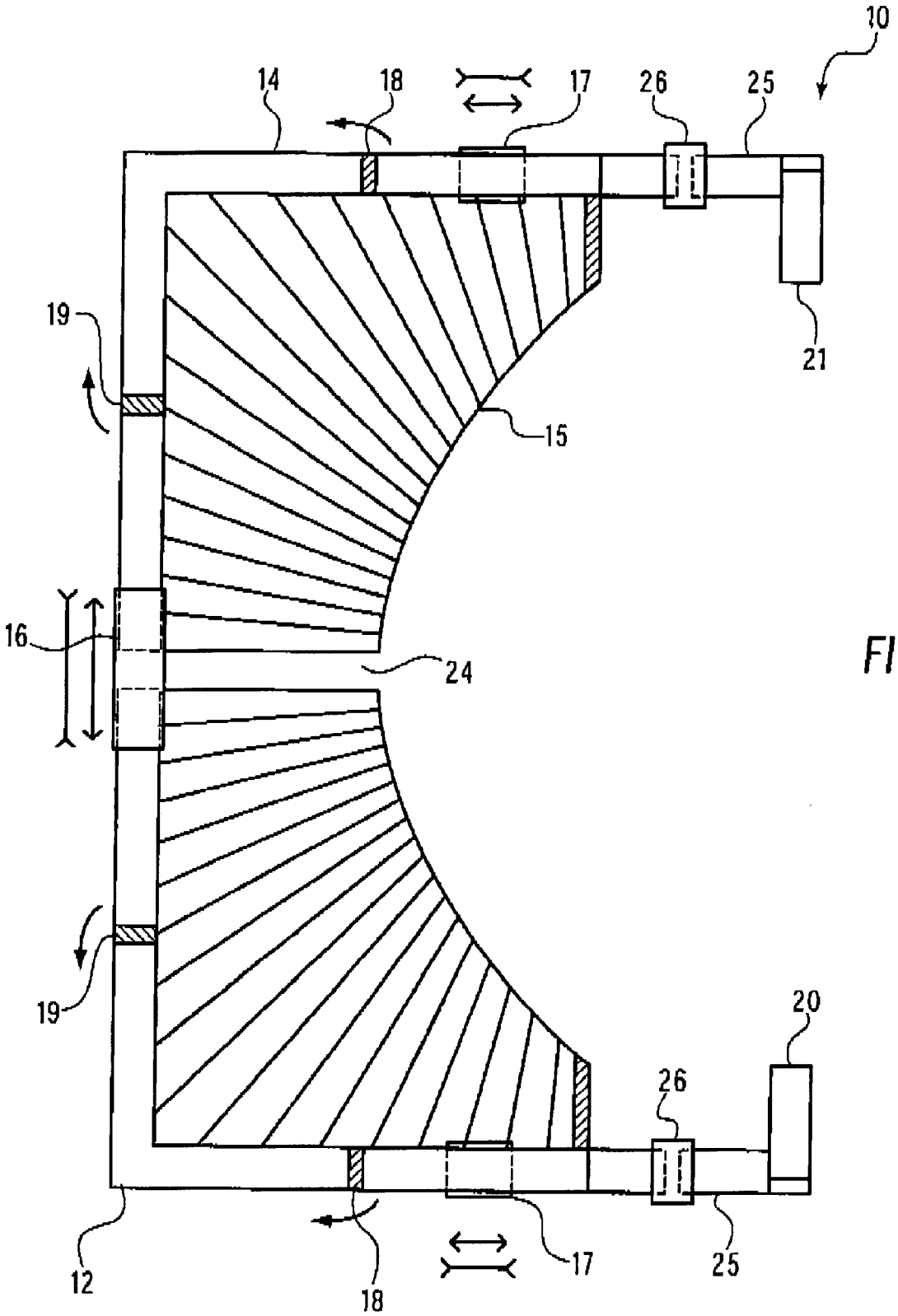
FIG. 1 shows a top view of the swing training device having legs.

Referring to the drawings FIG. 1 shows a swing training device 10 that contains a series of displaceable poles or bristles 15 that are used to guide a golfer's club through a swing. In this case, the swing guide comprises a first platform piece 12 and a second platform piece joined by a joint 16. Both first platform piece 12 and second platform piece 14 contain hinges 18 and 19 that allow first platform piece 12 and second platform piece 14 to fold up into a carryable platform.

To fold up first platform piece 12 and second platform piece 14, first platform piece 12 is detached from second platform piece 14 by pulling first platform piece 12 out of joint 16. Next, a front end of first platform piece 12 is folded over hinge 18 to collapse the front end of first platform piece 12. Next, platform piece 12 is folded up again over hinge 19 so that it forms a collapsed piece that is easily transportable.

Second platform piece 14 is folded up in a manner similar to first platform piece 12. Here, second platform piece 14 is first folded over hinge 18. Next, second platform piece 14 is folded over hinge 19 to create a collapsed piece that is easily transportable.

In addition, there are a series of swing trainers 20 and 21 that are attached to first platform piece 12 and second platform piece 14 respectively. Swing trainers 20 and 21 are designed as Substantially square shaped planar members that are positioned adjacent to a front end of first platform piece 12 and second platform piece 14. Here swing trainers 20 and 21 extend substantially vertical and are elevated above the ground (See FIG. 3) so that a club can fit below these swing trainers as a golfer moves through his swing.

For example, when using this device, a golfer first places a ball in a center gap 24 of the device 10 so that the golfer can still see the ball while swinging his or her club under the swing device. After the golfer has addressed the ball, and moves the head of his club back, the golf club head travels under the bristles or displaceable rods 15 until the golf club head clears the second platform piece 14, if the golfer is right handed, or the first platform piece 12, if the golfer is left handed. Next, the golfer raises his or her club head up so that this club head rises above either swing trainer 20 or swing trainer 21 depending on the rotation of the back swing. Once the golfer has reached the top of his or her back swing, the club head starts down substantially straight before either swing trainer 20 or 21 so that the golfer's club head moves underneath this swing trainer and then follows underneath first platform piece 12 and second platform piece 14.

Once the club head clears either the platform pieces 12 or 14 on the follow through, the golfer can then raise the club head up to pass above the remaining swing trainer.

Figure 2:
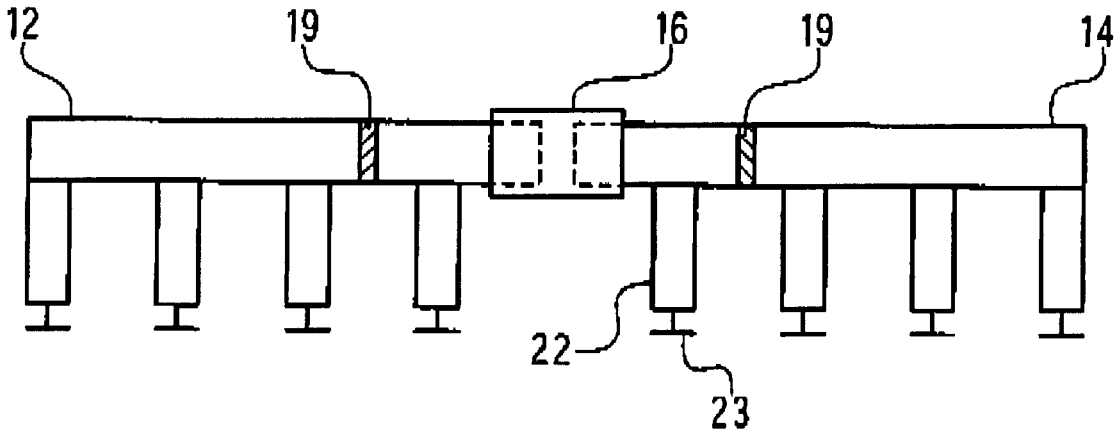
FIG. 2 shows a back side view of the swing training device.

In addition, as shown in FIG. 2, platform pieces 12 and 14 are raised up above a ground surface by a substantially vertical support shown in the preferred embodiment as legs 22. Legs 22 extend underneath platform pieces 12 and 14 and support platform pieces 12 and 14 above the ground. These legs also contain adjustable feet 23 pivotally mounted on an end of legs 22 so that legs 22 can stand on the ground. In this way, when a golfer's club head is swinging through a swing, the club head remains underneath the platform pieces 12 and 14 but above the ground surface.

Figure 3:
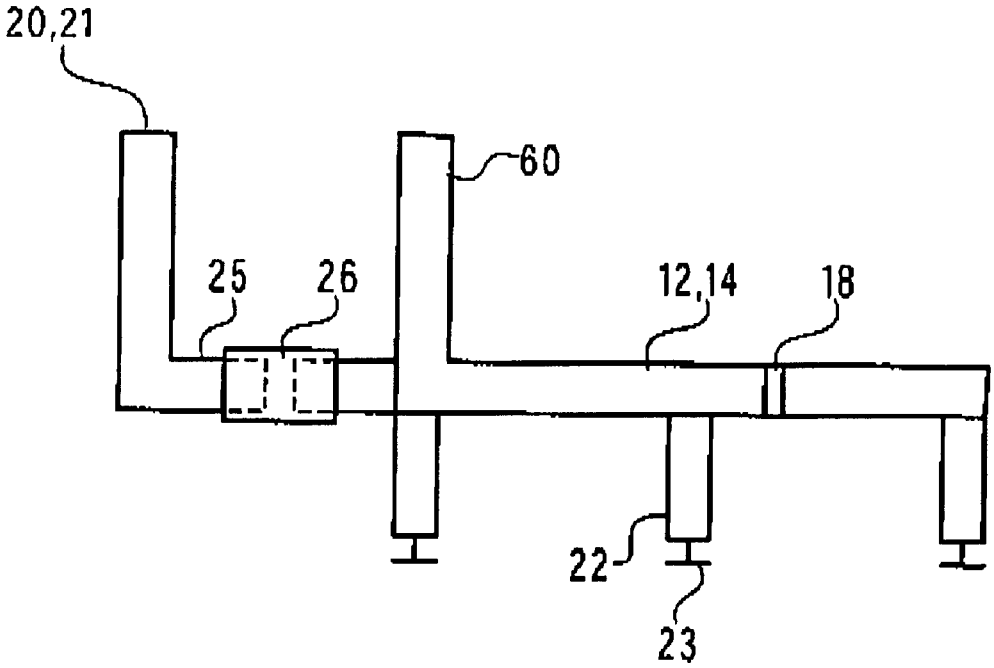
FIG. 3 shows a side view of the swing training device.

FIG. 3 shows a side view of the platform, showing swing trainers 20 and 21 extending out and substantially vertically up from platform pieces 12 and 14. In this case, swing trainers 20 and 21 are attached to first and second platform pieces 12 and 14 via a telescoping rod 25 having an adjustable bracket 26. Telescoping rod 25 along with adjustable bracket 26 are designed to allow swing trainers 20 and 21 to be adjusted either closer to, or farther away from platform pieces 12 and 14. This adjustment determines the angle at which the golfer swings his club. With this view, hinge 18 is shown, wherein hinge 18 allows platform pieces 12 and 14 to collapse onto themselves to form a smaller more compact platform. In addition, FIG. 3 shows the second embodiment of the invention showing a side view of vertical guides 60 attached to the front ends of platform pieces 12 and 14.

Figure 4:
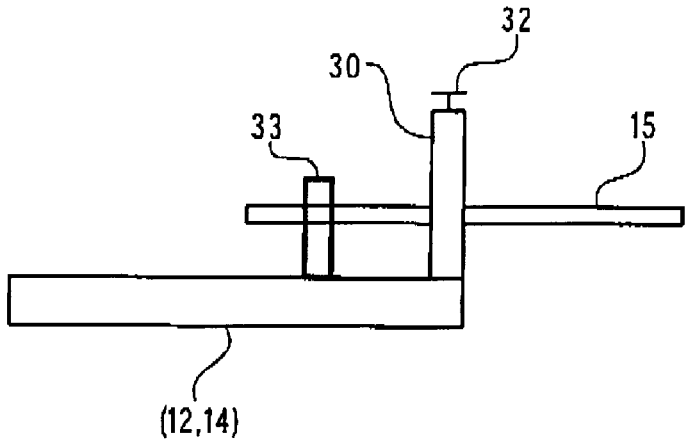
FIG. 4 shows a side view of the displaceable poles.

FIG. 4 shows a side view of the displaceable poles or bristles 15 wherein these poles are axially displaceable to adjust to the swing path of each individual golfer. In this case, the displaceable poles reside within an upright bracket 30 that attaches to both first platform piece 12 and second platform piece 14. Upright bracket 30 allows displaceable poles 15 to slide within this bracket wherein these displaceable poles are then secured by clamping pin 32 which when pressed down within upright bracket 30 lock displaceable poles in place. In addition, there is also a pole guide 33 that extends parallel to upright bracket 30 and is designed to receive poles or bristles 15. In this case, pole guide 33 is positioned on platform pieces 12 and 14 to allow poles or bristles 15 to extend outward while reducing any natural bending in poles or bristles 15.

Figure 5:
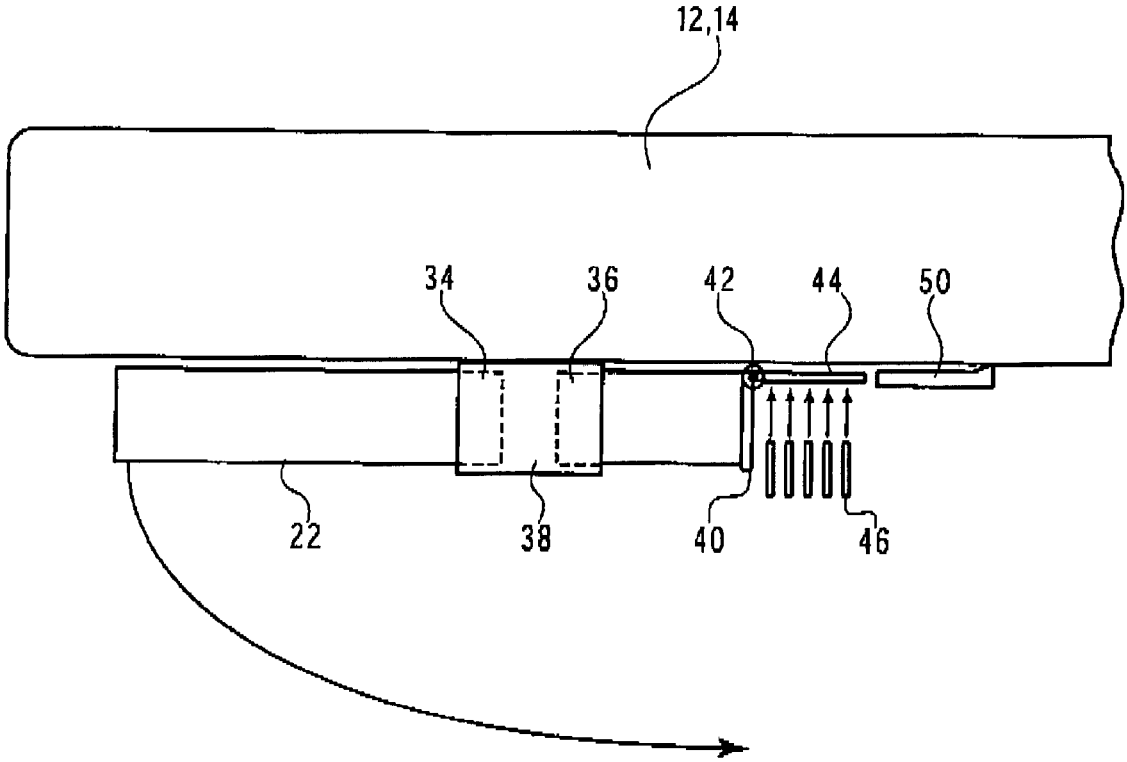
FIG. 5 shows a side view of the legs.

As shown in FIG. 5 legs 22 are designed as adjustable so that they can be extended out or contracted to either raise or lower platform pieces 12 and 14 depending on the desires of each golfer. Legs 22 can be adjusted so that platform pieces 12 and 14 can extend above a hitting surface within a range of 10 to 50 inches. Essentially, legs 22 contain a lower portion 34 and an upper portion 36 that are joined by adjustable clamp 38. Adjustable clamp 38 can be adjusted to either contract legs 22 so that lower portion 34 and upper portion 36 move together, or to expand legs 22 so that lower portion 34 and upper portion 36 move apart. Adjustable clamp 38 can be manufactured as adjustable by any means known in the art but is preferably a circumferential pressure clamp that when tightened, puts pressure around the outer faces or outer circumference of legs 22.

Attached to upper portion 36 is a leg hinge plate 40 that attaches to a hinge 42. In addition, platform hinge plate 44 connects to hinge 42 so that legs 22 can be attached to platform pieces 12 and 14. Platform hinge plate 44 connects to platform pieces 12 and 14 via a series of screws 46 that screw into platform pieces 12 and 14. Once leg 22 is attached to either platform piece 12 or platform piece 14, leg 22' can be rotated around on hinge 42 so that leg hinge plate 44 locks into a locking plate 50. Locking plate 50 allows leg hinge plate 44 to snap in around locking plate 50 to lock leg hinge plate flush against platform hinge plate 44. In this way, once each leg 22 is rotated up into its vertical position, it is locked in place in this vertical position to hold platform pieces 12 and 14 steady.

However, if a golfer or any other user wanted to collapse device 10, then legs 22 can be unlocked from locking plate 40, wherein legs 22 are rotated on hinge 42 to collapse legs 22. Next, platform pieces 12 and 14 are pulled apart and closed together via hinges 18 and 19. This allows the swing training device to be collapsed into a storable structure without taking up an inordinate amount of space.

Figure 6:
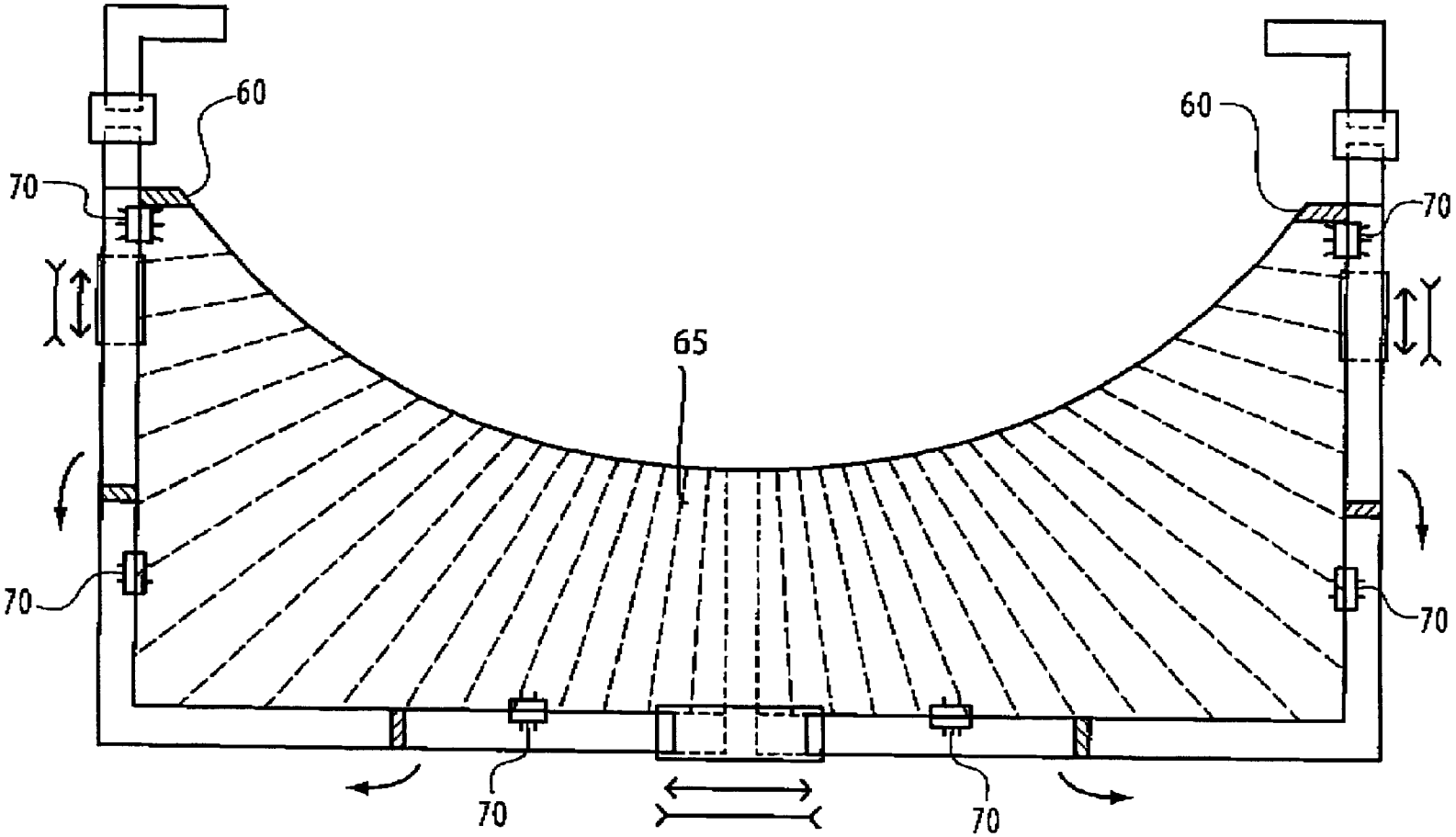
FIG. 6 shows a top view of the second embodiment of the invention.

FIG. 6 shows the second embodiment of the invention wherein in this case there is a removable solid top 65 that is attached to the golf swing training device via a series of clips 70. This removable solid top 65 is designed to cover the golf swing training device so that it forms a more rigid guide as a golfer proceeds through his or her swing. In addition in this embodiment there is also shown vertical guides 60 disposed on the front faces of platform pieces 12 and 14.

Essentially, this golf swing training device is designed to teach a golfer to swing his or her golf club using the new style swing described above. Because the golfer must keep his club head under platform pieces 12, and 14 during a portion of the golf swing, it forces the golfer to swing on a substantially horizontal plane. In addition, swing trainers 20 and 21 also force the golfer to raise the club up in a substantially vertical manner during the backswing and follow through. Thus, this design forces the golfer to divide his or her swing into a swing having both a substantially horizontal component and a substantially vertical component.

Accordingly, while a few embodiments of the present invention have been shown and described, it is to be understood that many changes and modifications may be made thereunto without departing from the spirit and scope of the invention.

What is claimed is:

1. A golf swing training device comprising:

a) a platform;

b) an adjustable substantially vertical support supporting said platform above a ground surface wherein said platform is raised above said ground surface to allow a club head to swing under said platform; and at least one substantially vertically extending barrier displaceably attached to said platform wherein said substantially vertically extending barrier is designed to guide a golf swing in a vertical direction.

2. The golf swing training device as in claim 1, wherein said adjustable substantially vertical support comprises a series of legs.

3. The golf swing training device as in claim 2, wherein said legs are rotatably attached to said platform.

4. The golf swing training device as in claim 2, wherein said legs further comprise impact absorbing material.

5. The golf swing training device as in claim 1, wherein said platform contains a series of displaceable poles that are axially adjustable within said platform so that said displaceable poles are adjustable to form a swing path.

6. The golf swing training device as in claim 1, wherein said platform has a front edge formed in a substantially semi-circular manner.

7. The golf swing training device as in claim 1, wherein said platform is set substantially parallel to said ground surface.

8. The golf swing training device as in claim 7 wherein said platform further comprises a removable solid top.

9. The golf swing training device as in claim 1, wherein said adjustable substantially vertical support is adjustable in height.

10. The golf swing training device as in claim 1, wherein said platform further comprises at least one hinge wherein said hinge allows said platform to collapse into a more compact size for transport or storage.

11. The golf swing training device as in claim 1, wherein said platform is designed as a set of flexible bristles to guide a golf club through a swing.

12. The golf swing training device as in claim 1, wherein said platform allows a golf club to substantially pass through said platform and indicates where said golf club passed through said platform.

13. The golf swing training device as in claim 1, further comprising a set of vertical guides attached to a front edge of said platform and disposed opposite said at least one substantially vertically extending barrier.

14. A golf swing training device comprising:

a) a platform which allows a golf club to substantially pass through said platform and indicates where said golf club passed through said platform; and b) an adjustable substantially vertical support supporting said platform above a ground surface wherein said platform is raised above said ground surface to allow a club head to swing under said platform.

15. A golf swing training device comprising:

a) a platform which includes a removable solid top and a plurality of flexible rods forming said platform; and b) an adjustable, substantially vertical support supporting said platform above a ground surface wherein said platform is raised above said ground surface to allow a club head to swing under said platform.

* * * * *